US010234139B2

(12) United States Patent
Masen

(10) Patent No.: US 10,234,139 B2
(45) Date of Patent: Mar. 19, 2019

(54) CONTROL SYSTEM AND METHOD FOR A SOLID FUEL COMBUSTION APPLIANCE

(71) Applicant: Maxitrol Company, Southfield, MI (US)

(72) Inventor: Mark Geoffrey Masen, Leonard, MI (US)

(73) Assignee: Maxitrol Company, Southfield, MI (US)

( * ) Notice: Subject to any disclaimer, the term of this patent is extended or adjusted under 35 U.S.C. 154(b) by 86 days.

(21) Appl. No.: 15/424,485

(22) Filed: Feb. 3, 2017

(65) Prior Publication Data

US 2017/0146239 A1 May 25, 2017

Related U.S. Application Data

(63) Continuation-in-part of application No. 13/113,669, filed on May 23, 2011, now Pat. No. 9,803,862.
(Continued)

(51) Int. Cl.

| | |
|---|---|
| ***F23B 30/00*** | (2006.01) |
| ***F23N 3/00*** | (2006.01) |
| ***F23N 3/04*** | (2006.01) |
| ***F23N 5/10*** | (2006.01) |
| ***F23B 90/00*** | (2011.01) |
| ***F23B 90/08*** | (2011.01) |

(Continued)

(52) U.S. Cl.
CPC ..... *F23N 3/002* (2013.01); *F23B 90/00* (2013.01); *F23B 90/08* (2013.01); *F23N 3/042* (2013.01); *F23N 5/102* (2013.01); *F24B 1/028* (2013.01); *F24B 5/023* (2013.01); *F23N 2023/38* (2013.01); *F23N 2025/10* (2013.01); *F23N 2035/06* (2013.01); *F23N 2037/12* (2013.01); *F23N 2041/02* (2013.01)

(58) Field of Classification Search
CPC ..... F23B 1/00
USPC ..... 126/502; 431/12
See application file for complete search history.

(56) References Cited

U.S. PATENT DOCUMENTS 741,474 A 10/1903 Ferry
2,032,252 A 2/1936 Burrow
(Continued)

FOREIGN PATENT DOCUMENTS

EP 0624756 A1 11/1994
EP 1356734 A1 10/2003
(Continued)

OTHER PUBLICATIONS

Final Office for U.S. Appl. No. 13/113,669; dated Feb. 9, 2017; 19 pages.

*Primary Examiner* — Avinash Savani
(74) *Attorney, Agent, or Firm* — Howard & Howard Attorneys PLLC

(57) ABSTRACT

Techniques for controlling a solid fuel combustion appliance, e.g., a wood burning stove, are disclosed. A control system measures an exhaust gas temperature of airflow through an outlet of the solid fuel combustion appliance. The control system determines a derivative of the exhaust gas temperature with respect to time. The derivative of the exhaust gas temperature with respect to time is compared to a predetermined threshold. The control system modulates the inlet damper in response to determining that the derivative of the exhaust gas temperature with respect to time reaches the predetermined threshold.

16 Claims, 5 Drawing Sheets

Related U.S. Application Data

(60) Provisional application No. 62/290,752, filed on Feb. 3, 2016, provisional application No. 61/351,477, filed on Jun. 4, 2010.

(51) Int. Cl.
*F24B 1/02* (2006.01)
*F24B 5/02* (2006.01)

(56) References Cited

U.S. PATENT DOCUMENTS

| | | | |
|---|---|---|---|
| 3,168,088 | A | 2/1965 | Martin et al. |
| 3,669,039 | A | 6/1972 | Martin et al. |
| 3,669,041 | A | 6/1972 | Schworer |
| 3,723,047 | A | 3/1973 | Baudelet de Livois |
| 3,982,525 | A | 9/1976 | Herman |
| 4,030,479 | A | 6/1977 | Webb |
| 4,136,662 | A | 1/1979 | Leman |
| 4,200,086 | A | 4/1980 | Kolb |
| 4,235,171 | A | 11/1980 | Leonard |
| 4,252,104 | A | 2/1981 | Morris |
| 4,253,404 | A | 3/1981 | Leonard |
| 4,263,887 | A | 4/1981 | Dowdall |
| 4,267,818 | A | 5/1981 | Taylor |
| 4,279,237 | A | 7/1981 | dePencier |
| 4,304,217 | A | 12/1981 | McGinn |
| 4,309,965 | A | 1/1982 | Willson |
| 4,312,278 | A | 1/1982 | Hill |
| 4,321,879 | A | 3/1982 | Toivo |
| 4,342,306 | A | 8/1982 | Smith et al. |
| 4,350,141 | A | 9/1982 | Miller |
| 4,355,587 | A | 10/1982 | Thulman et al. |
| 4,362,146 | A | 12/1982 | Thulman et al. |
| 4,374,569 | A | 2/1983 | Hayes |
| 4,387,699 | A | 6/1983 | Qualls |
| 4,442,825 | A | 4/1984 | Waldau |
| 4,457,294 | A | 7/1984 | Cumpston |
| 4,461,275 | A | 7/1984 | Lucas |
| 4,469,083 | A | 7/1984 | Lucas |
| 4,474,549 | A | 10/1984 | Capone |
| 4,492,560 | A | 1/1985 | Sundberg |
| 4,556,044 | A | 12/1985 | Barsness et al. |
| 4,675,029 | A | 6/1987 | Norman et al. |
| 4,681,087 | A | 6/1987 | Norman et al. |
| 4,712,095 | A | 12/1987 | Georgis, II |
| 4,766,876 | A | 8/1988 | Henry et al. |
| 4,862,869 | A | 9/1989 | Hazard |
| 5,007,404 | A | 4/1991 | Hall et al. |
| 5,014,680 | A | 4/1991 | Hall et al. |
| 5,033,363 | A | 7/1991 | King et al. |
| 5,179,933 | A | 1/1993 | McCrillis et al. |
| 5,391,074 | A | 2/1995 | Meeker |
| 5,873,356 | A | 2/1999 | Vossler et al. |
| 6,096,100 | A | 8/2000 | Guldi et al. |
| 7,457,689 | B2 | 11/2008 | Nelson et al. |
| 8,627,775 | B1 | 1/2014 | Wilson |
| 2001/0042610 | A1 | 11/2001 | Lyons et al. |
| 2003/0098358 | A1 | 5/2003 | Lyons et al. |
| 2004/0244791 | A1 | 12/2004 | Henry et al. |
| 2007/0068506 | A1 | 3/2007 | Lundberg |
| 2007/0289589 | A1 | 12/2007 | McFarland |
| 2008/0041357 | A1 | 2/2008 | Brown |
| 2008/0066661 | A1* | 3/2008 | Berkenkoetter ..... F24C 7/087 110/162 |
| 2008/0097649 | A1 | 4/2008 | Nelson et al. |
| 2008/0223266 | A1 | 9/2008 | Brazier et al. |
| 2009/0183693 | A1 | 7/2009 | Furman |
| 2010/0186645 | A1 | 7/2010 | Tiegs |
| 2010/0208765 | A1* | 8/2010 | Carlson ..... C21C 5/5211 373/9 |
| 2010/0326421 | A1 | 12/2010 | Atemboski et al. |
| 2011/0008214 | A1 | 1/2011 | Haas et al. |
| 2011/0094496 | A1 | 4/2011 | McCown |

FOREIGN PATENT DOCUMENTS

| | | | |
|---|---|---|---|
| WO | WO1987001432 | A1 | 3/1987 |
| WO | WO1996035912 | A1 | 11/1996 |
| WO | WO2009144393 | A1 | 12/2009 |
| WO | WO2010101171 | A1 | 9/2010 |

* cited by examiner

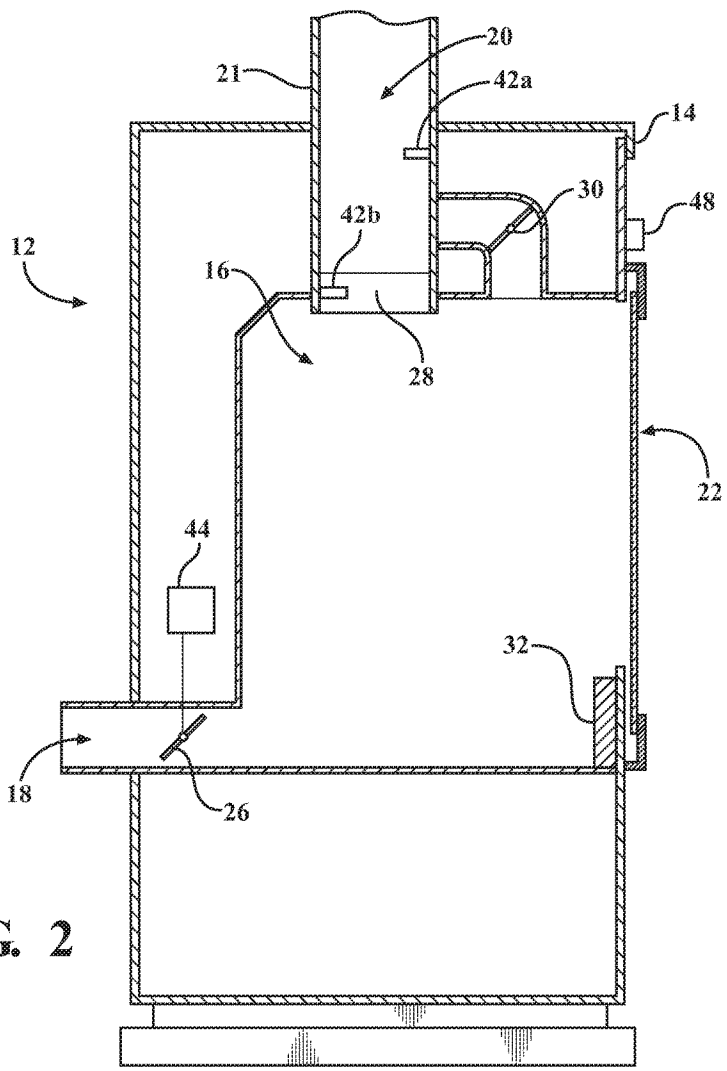
FIG. 2
FIG. 1
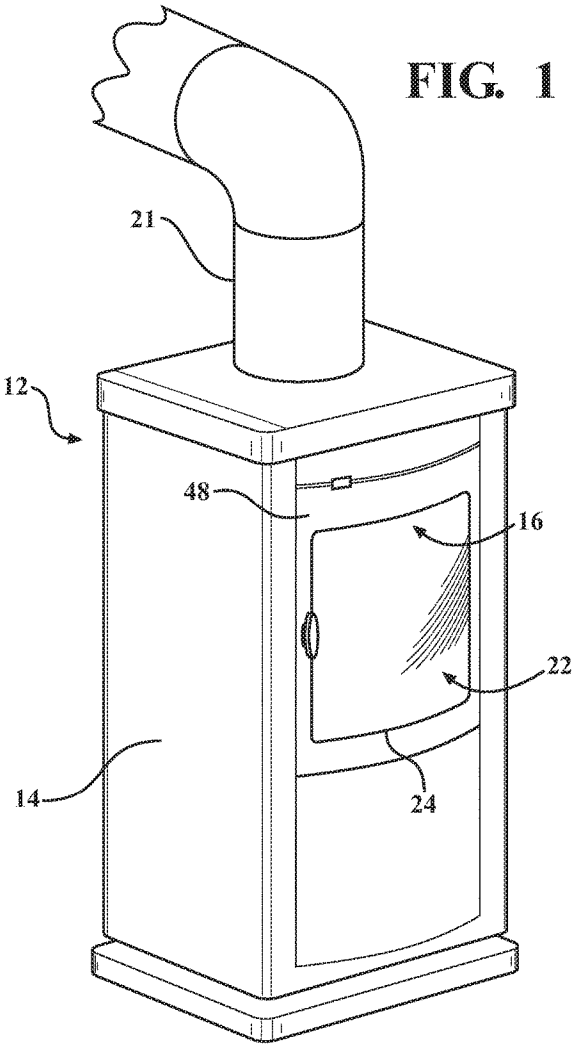

| Time (t in min) | Exhaust Gas Temperature (EGT in $^{o}F$) | $\frac{dEGT}{dt}$ ($^{o}F$/min) |
|---|---|---|
| 0 | 100 | N/A |
| 1 | 120 | 20 |
| 2 | 150 | 30 |
| 3 | 220 | 70 |
| 4 | 260 | 40 |
| 5 | 262 | 2 |
| 6 | 264 | 2 |
| 7 | 264 | 0 |
| 8 | 265 | 1 |
| 9 | 264 | -1 |
| 10 | 264 | 0 |

FIG. 4B

CONTROL SYSTEM AND METHOD FOR A SOLID FUEL COMBUSTION APPLIANCE

CROSS-REFERENCE TO RELATED APPLICATION

The present application is a continuation-in-part of U.S. patent application Ser. No. 13/113,669 filed on May 23, 2011, which claims priority to U.S. Provisional Patent Application No. 61/351,477 filed on Jun. 4, 2010. The present application also claims priority to U.S. Provisional Patent Application No. 62/290,752 filed Feb. 3, 2016, all of which are hereby incorporated by reference in their entirety.

BACKGROUND OF THE INVENTION

1. Field of the Invention

The invention relates to computerized control systems and methods for solid fuel combustion appliances, e.g., wood stoves.

2. Description of the Related Art

Wood burning stoves have a long and distinguished history for providing heating for houses and enclosures of every sort. The efficiency of such stoves has been steadily increasing in recent years, especially with the addition of catalysts to lower the burning temperature of the solid fuel. However, there still remains the possibility of peak efficiency and greater temperature control over such stoves.

BRIEF SUMMARY

A solid fuel combustion appliance, methods for operating the same, and a control system implemented by the same are provided. The appliance includes a housing defining a combustion chamber, an inlet, an outlet, and an opening. A door is operatively connected to the housing and positionable in a closed position to block the opening. An inlet damper is movable between a plurality of positions and is configured to control airflow into the inlet. A drive mechanism is operatively coupled to the inlet damper and is configured to control positions of the inlet damper. A controller is in communication with the drive mechanism and is configured to control operation of the drive mechanism. An exhaust temperature sensor is coupled to the controller and is configured to produce measurements of an exhaust gas temperature of airflow through the outlet. The controller is configured to receive measurements from the exhaust temperature sensor, determine a derivative of the exhaust gas temperature with respect to time, and compare the derivative of the exhaust gas temperature with respect to time to a predetermined threshold. The controller modulates the inlet damper in response to determining that the derivative of the exhaust gas temperature with respect to time reaches the predetermined threshold.

As such, the appliance, control system, and method utilize calculus computations relating to the derivative of the exhaust gas temperature with respect to time to provide more sophisticated and intelligent control over the progress of the combustion process. For instance, the predetermined threshold may be associated with a derivative value that indicates a property of the load of fuel in the combustion chamber, e.g., that the load of fuel undergoing combustion in the chamber has been successfully ignited. As such, the techniques provide control over the appliance in a way that is optimized for the particular load of fuel being consumed. The calculus computations are determined to learn about the progress of the combustion and to apply that information to the inlet damper adjustments suitable for any mode of operation. Computation of the derivative, by its nature, will accommodate many variables involved in control without reliance on preset relationships, e.g., between the damper and temperature. Accordingly, the techniques provide peak efficiency and greater temperature control. In this way, the appliance, control system, and method provide heating, while burning a load of fuel correctly and according to a manufacturer's specification. Advantages other than those described herein may be realized by these techniques.

BRIEF DESCRIPTION OF THE DRAWINGS

Other advantages of the disclosed subject matter will be readily appreciated, as the same becomes better understood by reference to the following detailed description when considered in connection with the accompanying drawings wherein:

FIG. 1 is a perspective view of an exemplary solid fuel combustion appliance for use with the control system and method;

FIG. 2 is a cross-sectional view of an exemplary solid fuel combustion appliance.

FIGS. 4A and 4B describe an operation of the control system using a flow chart and a corresponding data table.

DETAILED DESCRIPTION

Figure 3:
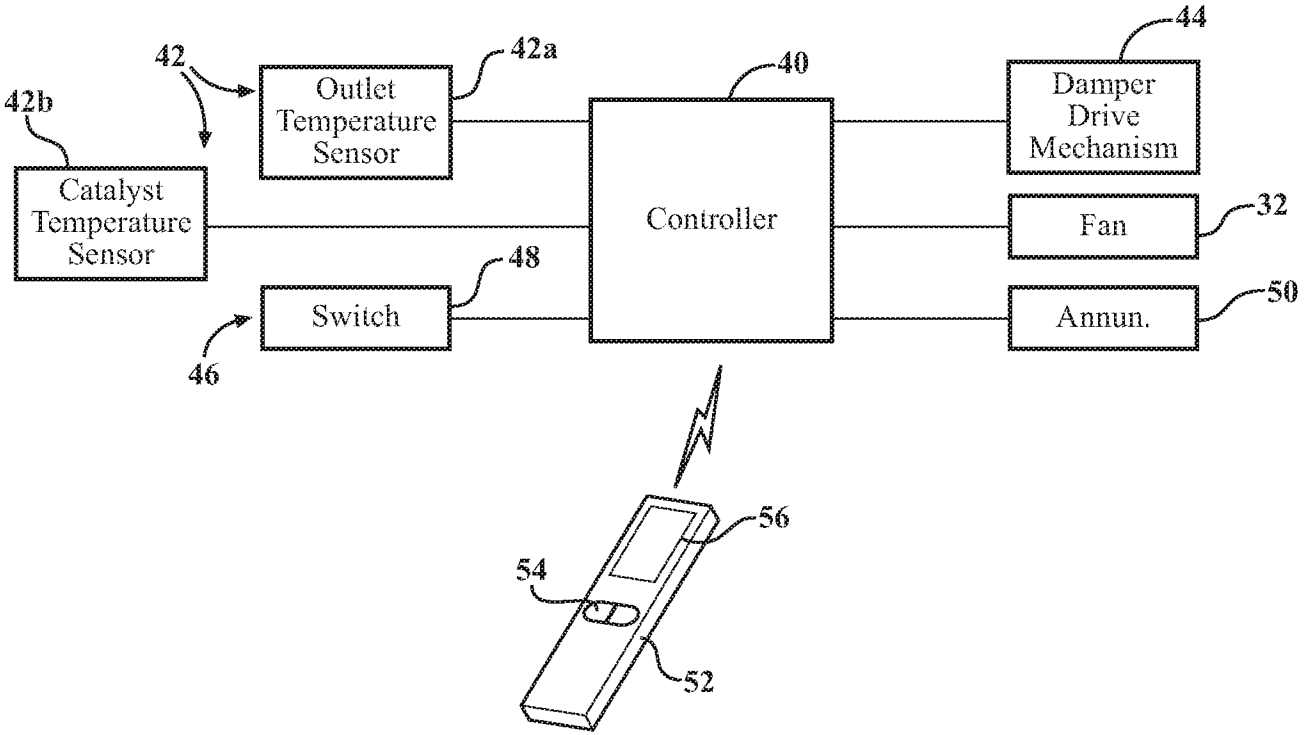
FIG. 3 is an electrical block diagram of the control system.

Referring to the Figures, wherein like numerals indicate like parts throughout the several views, a solid fuel combustion appliance 12, and a control system 10 and methods employed by the same are described and shown herein.

The control system 10 is used in conjunction with a solid fuel combustion appliance 12, as shown in FIG. 1. The appliance 12 may be alternatively referred to as a stove, a fireplace, a burner, or other name as appreciated by those skilled in the art. The solid fuel (not shown) burned with the appliance 12 may be wood, biomass, coal, charcoal, or other solid known to those skilled in the art. The solid fuel may be in log, pellet, chip, powder, briquette, or other suitable form known to those skilled in the art and typically dependent on the specific design and configuration of the appliance 12.

Referring now to FIG. 2, the appliance 12 includes a housing 14 defining a combustion chamber 16. The combustion chamber 16 may also be referred to by those skilled in the art as a "firebox". The housing 14 defines an inlet 18 and an outlet 20, each in fluidic communication with the combustion chamber 16. The inlet 18 supplies air to the combustion chamber 16 while the outlet 20 serves to exhaust combustion gases. In the illustrated embodiment, a chimney 21 is fluidly connected to the outlet 20 to exhaust the combustion gases to atmosphere, outside of a structure (not shown) where the appliance 12 is located, as is well known to those skilled in the art.

The housing 14 may further define an opening 22 in fluidic communication with the combustion chamber 16. The opening 22 may be utilized to add the solid fuel to the combustion chamber 16. In the illustrated embodiment, as shown in FIG. 1, a door 24 is operatively connected to the housing 14. For instance, the door 24 may be connected to the housing 14 with hinges (not shown). The door 24 is positionable in a plurality of positions including a closed position to block the opening 22. The opening 22 may be completely or at least partially blocked by the door 24 depending on the design and configuration of the appliance 12.

In one embodiment, the door 24 is manually opened by a user for adding solid fuel to the combustion chamber 16. In other embodiments, the solid fuel may be added automatically. For instance, an auger (not shown) may feed the solid fuel, especially in pellet form, through the opening 22 and to the combustion chamber 16.

Referring again to FIG. 2, the appliance 12 further includes an inlet damper 26. The inlet damper 26 is in fluidic communication with the inlet 18 and movable between a plurality of positions for controlling the flow of air into the inlet 18 and, as such, controlling the flow of air into the combustion chamber 16. The appliance 12 may also include an outlet damper (not shown) for closing off the outlet 20, e.g., when the appliance 12 is not in use.

The appliance 12 may also include a catalyst 28 fluidically disposed between the combustion chamber 16 and the outlet 20. As such, combustion gases pass through the catalyst 28 prior to being exhausted through the outlet. Those skilled in the art realized that the catalyst 28, often referred to as a catalytic converter, changes the rate of the chemical reaction, which, in this case, is the combustion or burning of the solid fuel. In particular, the catalyst 28 of the appliance 12 lowers the temperature at which smoke can catch fire. The appliance 12 may further include a catalyst damper 30 to allow the combustion gases to pass through the catalyst 28 or to bypass the catalyst 28.

The appliance 12 may also include a fan 32 for blowing air from the combustion chamber 16 to a space outside the housing 14. That is, the fan 32 may blow heated air from inside the housing 14 to outside the housing 14. Control of the fan 32 will be described in further detail hereafter.

Referring now to FIG. 3, the control system 10 includes a controller 40. The controller 40 controls various aspects of the combustion performed by the solid fuel combustion appliance 12 as described herein. In the illustrated embodiment, the controller 40 is programmable and executes a software program. The controller 40 may be implemented as a processor, microcontroller, microprocessor, application specific integrated circuit, or other suitable device or combination of devices capable of performing the functions described herein. The control system 10 may also include an analog-to-digital converter ("ADC") and a digital-to-analog converter ("DAC") for converting signals as is well known to those skilled in the art. The ADC and DAC may be integrated with the controller 40 or separate therefrom.

The control system 10 includes at least one temperature sensor 42. The temperature sensor 42 may be implemented as a thermocouple, a resistive temperature detector ("RTD"), infrared thermometer, or other suitable device as appreciated by those skilled in the art. The one temperature sensor 42 is coupled to the controller 40. Typically, the temperature sensor 42 is electrically connected to the ADC, which produces a digital value corresponding to the measured temperature to the controller 40. Of course, other techniques for transferring temperature data from the temperature sensor 42 to the controller 40 are realized by those skilled in the art.

The temperature sensor 42 may be implemented as an exhaust temperature sensor 42*a*. The exhaust temperature sensor 42*a* measures the temperature of air exhausted through the outlet 20. In the illustrated embodiment, the exhaust temperature sensor 42*a* is disposed in the chimney 21 adjacent the outlet 20. However, other suitable locations for positioning the exhaust temperature sensor 42*a* will be realized by those skilled in the art.

Alternatively or additionally, the temperature sensors 42 may be a catalyst temperature sensor 42*b*. The catalyst temperature sensor 42*b* measures the temperature of air passing through the catalyst 28. Accordingly, the catalyst temperature sensors 42*b* is disposed adjacent to the catalyst 28 or integrated within the catalyst 28.

In yet another embodiment, the temperature sensor 42 is a surface temperature sensor 42*c*. The surface temperature sensor 42*c* measures the temperature of surface of the solid fuel combustion appliance 12. Accordingly, the surface temperature sensor 42*c* is disposed onto the housing 14 of the appliance 12.

The control system 10 may employ any one or more of these temperature sensors 42*a*, 42*b*, 42*c* to make determinations as described herein.

The control system 10 also includes a drive mechanism 44 operatively connected to the inlet damper 26. The drive mechanism 44 controls the position of the inlet damper 26. As just one example, the drive mechanism 44 may control the position of the inlet damper 26 at five degree increments (e.g., 0% open, 5% open, 10% open, . . . 95% open, 100% open). The drive mechanism 44 may be a motor (not separately numbered) having a mechanical linkage (not shown) to the inlet damper 26. However, other devices may be implemented as the drive mechanism 44. The drive mechanism 44 is in communication with the controller 40 such that the controller 40 issues commands and/or signals to the drive mechanism 44 for controlling the position of the inlet damper 26.

The control system 10 may further include a detector 46 for signaling a certain condition of the solid fuel in the combustion chamber 16. The detector 46 is in communication with the controller 40 such that the controller 40 receives a signal when the certain condition of the solid fuel is ascertained. In the illustrated embodiment, the certain condition is the addition of solid fuel.

The detector 46 of the illustrated embodiment is implemented as a switch 48 electrically connected to the controller 40. In one technique, the switch 48 is coupled to the housing 14 to operatively engage the door 24 to signal when the door 24 has been opened and reclosed. The opening and reclosing of the door 24 thus signals the addition of solid fuel to the combustion chamber 16. In another technique, the switch 48 is disposed in a position allowing the user to manually depress the switch 48, thus signaling the addition of solid fuel to the combustion chamber 16. In yet another technique, the switch 48 is operatively connected to the auger to sense when the auger is adding solid fuel to the combustion chamber 16.

The detector 46 may be implemented with devices other than the switch 48 in other embodiments. In one example, an optical device (not shown) may be utilized to sense when the door 24 is opened and reclose or when additional solid fuel is added to the combustion chamber 16. In another example, a capacitive sensor (not shown) may be implemented to sense the amount of solid fuel in the combustion chamber 16 and thus determine whether additional sold fuel has been added.

The controller 40 may also be in communication with the fan 32 for controlling operation of the fan 32. For example, the controller 40 may operate a relay (not shown) for turning the fan 32 on and off. Alternatively, the controller 40 may be electrically connected to a motor (not shown) of the fan 32 to more precisely control the speed of the fan 32, and thus the airflow produced by the fan 32.

The control system 10 of the illustrated embodiment further includes an annunciator 50 in communication with the controller 40. The annunciator 50 may be implemented as any device capable of providing information to the user. For instance, the annunciator 50 may be implemented as a light, a display, and/or a speaker. Those skilled in the art will realize other techniques to implement the annunciator 50.

The control system 10 may further include a remote control device 52 in communication with the controller 40 such that commands and/or data may be sent back-and-forth between the remote control device 52 and the controller 40. The communications between the controller 40 and the remote control device 52 may be implemented via radio frequency ("RF") signals, optical signals (e.g., infrared or ultraviolet), or a combination of RF and optical signals. Those skilled in the art realize other techniques for facilitating communications between the remote control device 52 and the controller 40.

The remote control device 52 allows the user to control operation of the controller 40 and to receive information from the controller 40. The remote control device 52 of the illustrated embodiment includes a plurality of pushbuttons 54 for receiving input from the user and a display 56 for providing information to the user. Of course, other techniques for receiving input from the user and providing information to the user may alternatively be implemented.

In addition to or as a substitute to the remote control device 52, the control system 10 may also include pushbuttons, switches, keypads, or other controls (none of which are shown) electrically connected to the controller 40. For instance, DIP switches (not shown) may be mounted on a printed circuit board (not shown) which also supports the controller 40.

In the illustrated embodiment, the controller 40 operates an automatic mode or a manual mode. In the manual mode, the user may control some or all of the control elements of the control system 10 manually. For example, the user may utilize the remote control device 52 to manually open and close the inlet damper 26 to maintain control over the temperature output from the appliance 12. In the automatic mode, the controller 40 generally attempts to control for output temperature of the combustion. The mode of the controller 40 may be selected or controlled utilizing the remote control device 52.

Figure 4A:
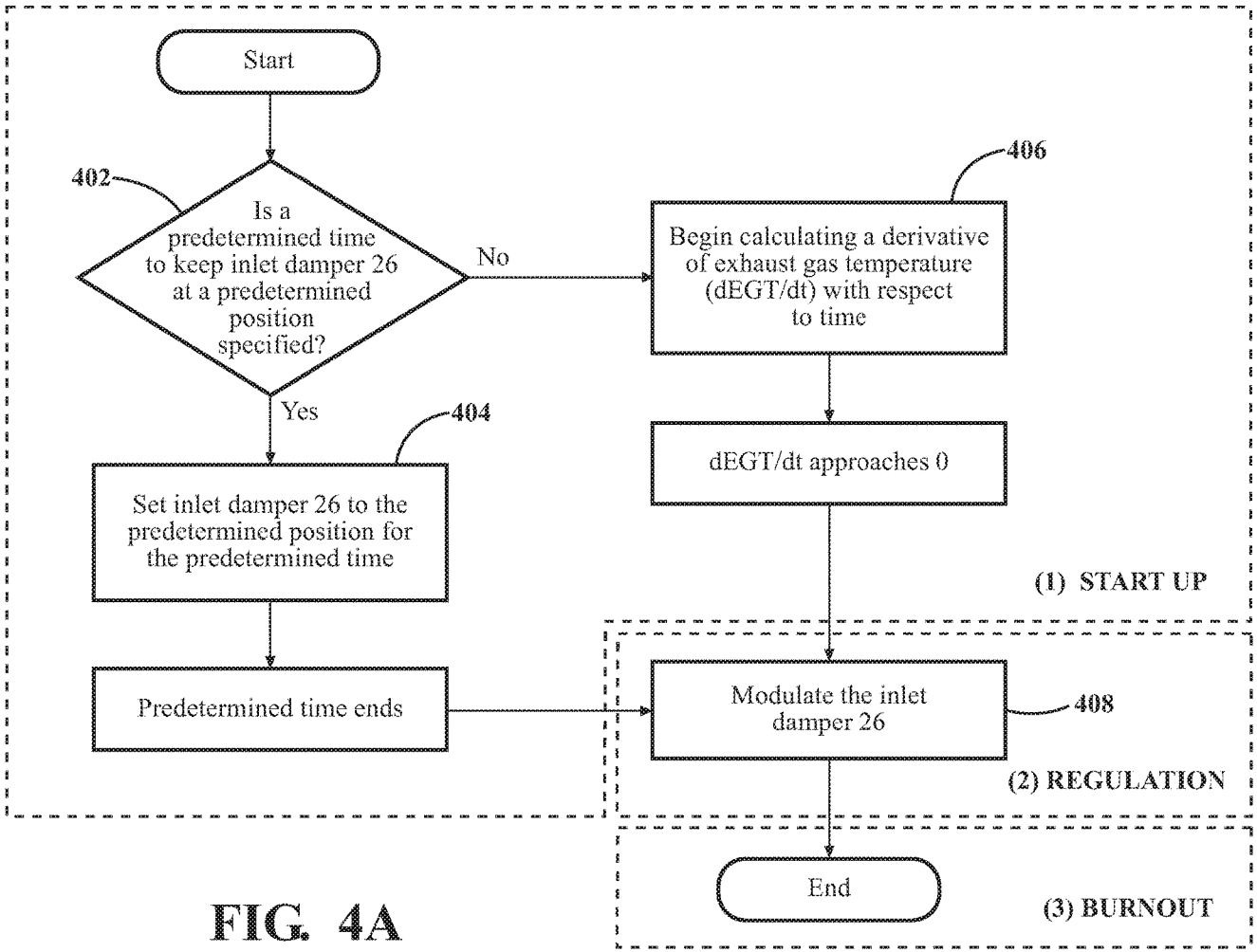

FIG. 4A is a flow chart to describe an operation of the controller 40 in an embodiment of automatic mode. In the embodiment of automatic mode shown in FIG. 4A, the automatic mode is divided into three main stages: (1) STARTUP, (2) REGULATION, and (3) BURNOUT. During the first stage, (1) STARTUP, solid fuel is added to the combustion chamber 16 and the combustion process begins. During the second stage, (2) REGULATION, the controller 40 actively modulates control of the inlet damper 26 to achieve a desired result. In this stage, however, the controller 40 attempts to control for an output temperature of the combustion, also known as an exhaust gas temperature of airflow through the outlet 20, or EGT. During the third stage, (3) BURNOUT, the combustion process ends.

During the first stage of automatic mode, (1) STARTUP, solid fuel is added to the combustion chamber 16 and the controller 40 positions the inlet damper 26 to not only ensure full combustion of the solid fuel, but to mitigate variables contributing to an inefficient combustion. For example, during complete oxidation, almost all carbon in the solid fuel bonds with available oxygen ($O_2$), triggering a creation of carbon dioxide ($CO_2$) and ultimately, heat. In contrast, incomplete combustion occurs when there is not enough $O_2$ to allow the solid fuel to react completely and produce $CO_2$, leaving only some $O_2$ to bond with carbon, creating carbon monoxide (CO). Heat produced during the creation of $CO_2$ is almost double that of CO, making complete oxidation a more efficient form of combustion. Therefore, to allow complete combustion of the solid fuel the controller 40 positions the inlet damper 26 to provide maximum airflow to the combustion chamber 16, allowing a plethora of available $O_2$. Furthermore, once the solid fuel begins to combust, the process may be interrupted if the inlet damper 26 closes too early and the flow of $O_2$ to the combustion chamber 16 is limited. When the combustion process is interrupted, complete combustion does not occur as CO levels begin to rise in the combustion chamber and the amount of heat produced declines.

Referring to FIG. 4A, (1) STARTUP, features two methods of operation that ensure complete and uninterrupted combustion startup of the solid fuel in the combustion chamber 16. In the first method of operation, represented by step 404 in FIG. 4A, the controller 40 ensures the combustion of the fuel by controlling the drive mechanism 44 to position the inlet damper 26 at a predetermined position for a predetermined amount of time. In the second method of operation, represented by step 406 in FIG. 4A, the controller 40 controls the drive mechanism 44 to position the inlet damper 26 at predetermined or variable positions and computes a derivative of EGT with respect to time to determine the progress of the combustion process. The derivative is the rate of change of the EGT over time, and not simply the change of the EGT. In the embodiment shown in FIG. 4A, the controller 40 chooses between these two methods of operation by determining if the predetermined time is specified to maintain the inlet damper 26 at the predetermined position. This determination is shown in step 402 of FIG. 4A. As shown, the step of determining the derivative occurs in response to determining that no predetermined time is specified to maintain the inlet damper 26 at a predetermined position. In other words, step 406 occurs for a variable amount of time that is not predetermined. This variable amount of time will depend on the specific characteristics/properties of the fuel undergoing combustion and therefore provides a more dynamic and higher order approach to control.

At step 404, the controller 40 reacts to the certain condition of the solid fuel sensed by the detector 46, for instance. In response to the certain condition of the solid fuel, the controller 40 controls the drive mechanism 44 to position the inlet damper 26 at a predetermined position for a predetermined period of time. The predetermined position and period of time are chosen such that a complete combustion of the solid fuel will occur when the inlet damper 26 is at the predetermined position for the period of time. For example, in one embodiment, the controller 40 controls the drive mechanism 44 to position the inlet damper 26 at a fully-open position for about one minute, ensuring a complete combustion of the solid fuel. After the predetermined period of time has expired, the controller 40 enters the second stage, (2) REGULATION, and begins to modulate the inlet damper 26.

At step 406, the controller 40 may similarly react initially to the certain condition of the solid fuel sensed by the detector 46. In response to the certain condition of the solid fuel, the controller 40 controls the drive mechanism 44 to position the inlet damper 26 at predetermined or variable positions and computes the derivative of EGT with respect to time to determine the progress of the combustion process. Specifically, the controller 40 measures EGT, determines a derivative of EGT with respect to time, and compares the derivative of EGT to a predetermined threshold. These steps are repeated until the derivative of EGT with respect to time reaches the predetermined threshold thereby indicating a complete combustion of the solid fuel.

The controller 40 may employ any suitable techniques, software, programming, and/or electrical or electronic components for calculating the derivative of EGT. In one example, the signals from the temperature sensor 42 are converted into digital signals. The digital signals may be any suitable value depending on the configuration of the temperature sensor 42 or measurements derived therefrom. For example, the signals may be voltage, current, capacitance or the like. These values may be logged over time and stored in memory coupled to the controller 40. In memory, these values may be associated with a specific EGT in a look-up table, wherein the association is based on predetermined or calibrated data about the temperature sensor 42. The controller 40 may employ logic means or other computation programming for calculating dEGT/dt.

Figure 5:
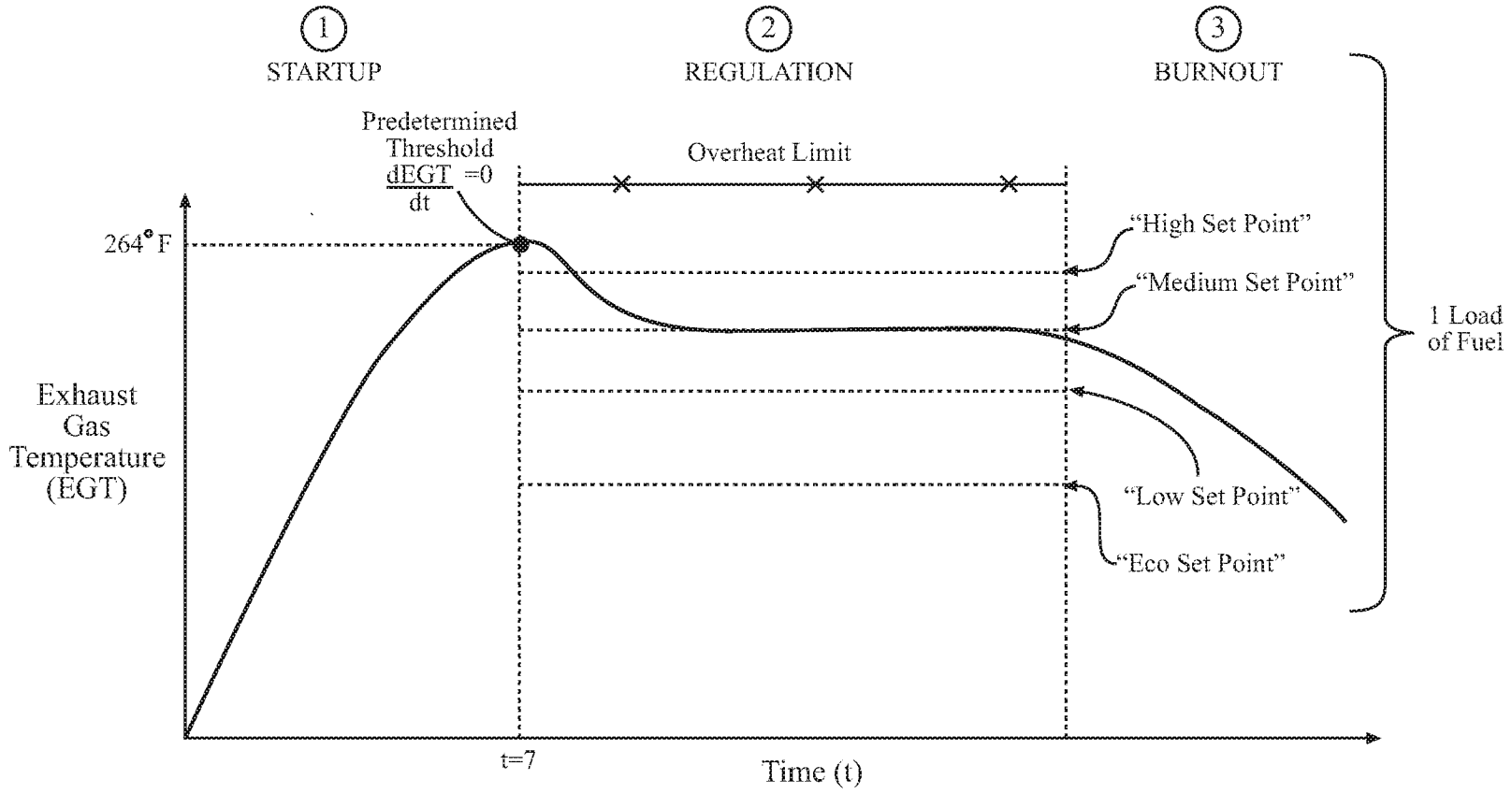
FIG. 5 is an exemplary chart of a temperature of airflow through an outlet of the solid fuel combustion device with respect to time of during an operation of the control system.

For reference, FIG. 4B and FIG. 5 show an exemplary determination of the derivative of EGT with respect to time. In the embodiment shown in FIG. 4B, the predetermined threshold is zero or approximately zero. As shown, the derivative of EGT reaches the predetermined threshold at time t=7. After the derivative of EGT with respect to time reaches the predetermined threshold, the controller 40 enters the second stage, (2) REGULATION, and begins to modulate the inlet damper 26.

FIG. 5 is an exemplary chart of EGT with respect to time of the embodiment of automatic mode where the controller 40 controls the inlet damper 26 according to the second method of operation (i.e., calculating EGT). FIG. 5 also illustrates the relationship between the three stages, (1) STARTUP, (2) REGULATION, and (3) BURNOUT. As shown in FIG. 5, once the derivative of EGT with respect to time reaches the predetermined threshold (shown at t=7 for example) in this embodiment, the predetermined threshold is again zero or approximately zero—the controller 40 enters the second stage, (2) REGULATION.

Thereafter, the controller 40 controls the drive mechanism 44 to position the inlet damper 26 to maintain a predetermined EGT. The predetermined EGT may be one temperature or a range of temperatures. For instance, in one implementation, the predetermined EGT may range from 260° C. to 280° C. As such, the controller 40 may incrementally close the inlet damper 26 as the temperature rises and approaches or exceeds 280° C. to reduce the amount of air, and consequently oxygen, that is available to the fire. Likewise, the controller 40 may incrementally open the inlet damper 26 as EGT falls and approaches or passes 260° C. In one embodiment, the controller 40 controls the inlet damper 26 in response to selecting one of a plurality of operation settings. The control to maintain EGT may be implemented with the controller 40 utilizing a closed-loop technique, such as proportional-integral ("PI") or proportional-integral-derivative ("PID") techniques, or the like.

In one embodiment, the controller 40 controls the drive mechanism 44, during (2) REGULATION, to position the inlet damper 26 in response to the user selecting one of a plurality of operation settings where the plurality of operation settings specify a set point for EGT. The controller 40 uses this set point as the predetermined EGT for controlling the inlet damper 26. Referring to FIG. 5, four operation settings of automatic mode are shown in the second stage, (2) REGULATION: "High Set Point", "Medium Set Point", "Low Set Point", and "Eco Set Point". In FIG. 5, the user selects the "Medium Set Point" operation setting and the controller 40 maintains EGT according to the specified set point. It is to be noted that, while FIG. 5 represents the embodiment of automatic mode where the controller 40 controls the inlet damper 26 according to the second method of operation, the above described embodiment of the second stage, (2) REGULATION, can apply to any automated method of operation/control.

Other embodiments of automatic mode provide additional operation settings, selectable by the user. For instance, in a "long-burn" operation setting of automatic mode, the set point for EGT is set very low, but still high enough to support combustion. In another instance, in a "high output" operation setting of automatic mode, the set point for EGT is at or near a maximum safe operating temperature (labeled "Overheat Limit" in FIG. 5).

During the third stage of automatic mode, (3) BURNOUT, the combustion process ends. The third stage, (3) BURNOUT, may be induced by the controller 40, or may occur naturally. In one embodiment, the controller 40 induces the third stage, (3) BURNOUT, by restricting the amount of oxygen delivered to the combustion chamber to end the combustion process, e.g. the controller 40 may position the inlet damper 26 to a closed position. In another embodiment, the controller 40 induces the third stage, (3) BURNOUT, in response to detecting that the fuel from the combustion chamber 16 has been removed thereby ending the combustion process. In yet another embodiment of automatic mode, the combustion process ends naturally when the fuel is burned up. Any components of the control system 10 may be utilized to make determinations regarding when to trigger the (3) BURNOUT stage.

As previously discussed, the controller 40 is able to control the inlet damper 26 in response to a predetermined time or in response to the derivative of EGT during the first stage of automatic mode, (1) STARTUP. Furthermore, the controller 40 is able to control the inlet damper 26 to maintain a set point for EGT during the second stage of automatic mode, (2) REGULATION, and induce an end of the combustion process in the third stage, (3) BURNOUT. However, it is contemplated that, in other embodiments of automatic mode, the controller 40 may control the inlet damper 26 in accordance with at least one of a variety of other parameters and during any stage of automatic mode. The variety of other parameters may include a set point for the surface temperature of the solid fuel combustion appliance 12, an amount of CO gas output by the solid fuel combustion appliance 12 during combustion, an $O_2$ concentration within the combustion chamber 16, or an energy efficiency of the solid fuel combustion appliance 12. It is also contemplated the user may select which of the variety of parameters the controller 40 will control for via a selectable operation setting. The control of the variety of other parameters may be implemented with a proportional-integral ("PI") or proportional-integral-derivative ("PID") techniques, or other suitable techniques.

In a specific example of one such embodiment, the controller 40 controls the drive mechanism 44 based on temperature of the room, i.e., the area outside of the appliance 12 itself. This is accomplished with a thermostat (not shown) or other device in communication with the controller 40. Furthermore, the controller 40 may also provide for different conditions of the solid fuel. For instance, the controller 40 may include a "wet wood" automatic mode. In this mode, the controller 40 will control for a higher temperature output due to the wet nature of the solid fuel. Similarly, the controller 40 can control for a higher temperature output when compensating for larger loads.

In other embodiments, the controller 40 receives both the temperature of the air passing through the outlet 20 and the temperature of the air passing through the catalyst 28. By analyzing these two temperatures, the controller 40 determines when the solid fuel is expiring. Specifically, when both temperatures fall by a predetermined amount for a predetermined period of time, the controller 40 ascertains that the solid fuel is near the end of its combustible life. In response to the solid fuel expiring, the controller 40 communicates the expiration via the annunciator 50. For instance, in one embodiment, the controller 40 may activate an LED (not shown) affixed to the housing. Furthermore, it is to be noted that this embodiment, along with all of the previous embodiments pertaining to automatic or manual mode, can be executed using just two thermocouples.

Additionally, it is to be appreciated that the embodiments of automatic mode in FIG. 5 and FIG. 4A have shown a sequential operation of the controller 40. That is, the controller 40 has only been shown to transition from the first stage, (1) STARTUP, to the second stage, (2) REGULATION, and then to the third stage (3) BURNOUT. In other embodiments, the controller 40 is able to transition between the stages in a more indeterminate fashion. For example, if, during the second stage, (2) REGULATION, the detector 46 detects that additional solid fuel is added to the combustion chamber 16, the controller 40 may transition back to the first stage, (1) STARTUP. As another example, if the user opts to turn off the solid fuel combustion appliance 12 prior to combustion, the controller 40 may transition from the first stage, (1) STARTUP, directly to the third stage, (3) BURNOUT.

The present invention incorporates by reference U.S. patent application Ser. No. 13/113,669 filed on May 23, 2011, which claims priority to U.S. Provisional Patent Application No. 61/351,477 filed on Jun. 4, 2010 for features disclosed therein, which are common support for the appended claims. The disclosure of U.S. patent application Ser. No. 13/113,669 filed on May 23, 2011, which claims priority to U.S. Provisional Patent Application No. 61/351,477 filed on Jun. 4, 2010 is hereby fully incorporated by reference.

The present invention has been described herein in an illustrative manner, and it is to be understood that the terminology which has been used is intended to be in the nature of words of description rather than of limitation. Obviously, many modifications and variations of the invention are possible in light of the above teachings. The invention may be practiced otherwise than as specifically described within the scope of the appended claims.

The invention claimed is:

1. A solid fuel combustion appliance comprising:

a housing defining a combustion chamber, an inlet, an outlet, and an opening;

a door operatively connected to said housing and positionable in a closed position to block said opening;

an inlet damper movable between a plurality of positions and being configured to control airflow into said inlet;

a drive mechanism operatively coupled to said inlet damper and being configured to control positions of said inlet damper;

a controller in communication with said drive mechanism and being configured to control operation of said drive mechanism;

a surface temperature sensor coupled to said controller and being configured to produce measurements of a surface temperature of said housing;

an exhaust temperature sensor coupled to said controller and being configured to produce measurements of an exhaust gas temperature of airflow through said outlet; and wherein said controller is configured to:

receive measurements from said exhaust temperature sensor;

determine a derivative of the exhaust gas temperature with respect to time;

compare the derivative of the exhaust gas temperature with respect to time to a predetermined threshold; and modulate said inlet damper in response to determining that the derivative of the exhaust gas temperature with respect to time reaches the predetermined threshold.

2. The solid fuel combustion appliance as set forth in claim 1 wherein said controller is further configured to determine whether a predetermined time is specified to maintain the inlet damper at a predetermined position.

3. The solid fuel combustion appliance as set forth in claim 2 wherein said controller is further configured to determine the derivative in response to determining that no predetermined time is specified to maintain the inlet damper at a predetermined position.

4. The solid fuel combustion appliance as set forth in claim 1 wherein said controller is further configured to indefinitely determine the derivative until the derivative of the exhaust gas temperature with respect to time reaches the predetermined threshold.

5. The solid fuel combustion appliance as set forth in claim 1 wherein the predetermined threshold is zero or approximately zero.

6. The solid fuel combustion appliance as set forth in claim 1 wherein said controller is further configured to modulate the inlet damper in response to selecting one of a plurality of operation modes, wherein the plurality of operation modes specifies a set point for the exhaust gas temperature.

7. A method for operating a solid fuel combustion appliance comprising a controller, an inlet damper and an outlet, said method comprising the steps of:

measuring, with the controller, an exhaust gas temperature of airflow through the outlet of the solid fuel combustion appliance;

determining, with the controller, a derivative of the exhaust gas temperature with respect to time;

comparing, with the controller, the derivative of the exhaust gas temperature with respect to time to a predetermined threshold;

determining, with the controller, whether a predetermined time is specified to maintain the inlet damper at a predetermined position; and modulating the inlet damper in response to the controller determining that the derivative of the exhaust gas temperature with respect to time reaches the predetermined threshold.

8. The method as set forth in claim 7 wherein the step of determining the derivative occurs in response to the controller determining that no predetermined time is specified to maintain the inlet damper at a predetermined position.

9. The method as set forth in claim 7 wherein the step of determining the derivative occurs indefinitely until the derivative of the exhaust gas temperature with respect to time reaches the predetermined threshold.

10. The method as set forth in claim 7 wherein the predetermined threshold is zero or approximately zero.

11. The method as set forth in claim 7 wherein the step of modulating the inlet damper occurs in response to selecting one of a plurality of operation modes, wherein the plurality of operation modes specify a set point for the exhaust gas temperature.

12. A control system for a solid fuel combustion appliance, said control system being configured to:

measure an exhaust gas temperature of airflow through the outlet of the solid fuel combustion appliance;

determine a derivative of the exhaust gas temperature with respect to time;

compare the derivative of the exhaust gas temperature with respect to time to a predetermined threshold; and modulate the inlet damper in response to determining that the derivative of the exhaust gas temperature with respect to time reaches the predetermined threshold;

wherein the control system is configured to determine whether a predetermined time is specified to maintain the inlet damper at a predetermined position.

13. The control system as set forth in claim 12 further being configured to determine the derivative in response to determining that no predetermined time is specified to maintain the inlet damper at a predetermined position.

14. The control system as set forth in claim 12 further being configured to indefinitely determine the derivative until the derivative of the exhaust gas temperature with respect to time reaches the predetermined threshold.

15. The control system as set forth in claim 12 wherein the predetermined threshold is zero or approximately zero.

16. The control system as set forth in claim 12 further being configured to modulate the inlet damper in response to selecting one of a plurality of operation modes, wherein the plurality of operation modes specify a set point for the exhaust gas temperature.

* * * * *